US005827333A

United States Patent [19]

Cherpeck

[11] Patent Number: 5,827,333

[45] Date of Patent: Oct. 27, 1998

[54] SUBSTITUTED BIPHENYL ETHERS AND FUEL COMPOSITIONS CONTAINING THE SAME

[75] Inventor: Richard E. Cherpeck, Cotati, Calif.

[73] Assignee: Chevron Chemical Company LLC, San Francisco, Calif.

[21] Appl. No.: 940,430

[22] Filed: Sep. 30, 1997

[51] Int. Cl.[6] ..... C10L 1/18

[52] U.S. Cl. ..... 44/384; 44/413; 44/424; 44/425; 44/426; 44/427; 44/428; 564/337; 564/384; 564/389; 568/585; 568/631; 568/642

[58] Field of Search ..... 44/384, 413, 424, 44/425, 427, 426, 428; 564/337, 384, 389; 568/585, 631, 642

[56] References Cited

U.S. PATENT DOCUMENTS

| | | | |
|---|---|---|---|
| 4,191,537 | 3/1980 | Lewis et al. | 44/71 |
| 4,320,021 | 3/1982 | Lange | 44/413 |
| 4,881,945 | 11/1989 | Buckley | 44/72 |
| 5,081,295 | 1/1992 | Reardan et al. | 564/163 |
| 5,090,914 | 2/1992 | Reardan et al. | 435/188 |
| 5,103,039 | 4/1992 | Reardan et al. | 560/33 |
| 5,157,099 | 10/1992 | Reardan et al. | 528/68 |
| 5,296,003 | 3/1994 | Cherpeck | 44/389 |
| 5,409,507 | 4/1995 | Cherpeck | 44/413 |
| 5,637,119 | 6/1997 | Cherpeck | 44/384 |
| 5,709,720 | 1/1998 | Cherpeck | 44/413 |

*Primary Examiner*—Jacqueline V. Howard
*Attorney, Agent, or Firm*—Claude J. Caroli

[57] ABSTRACT

Substituted biphenyl polyalkyl ethers having the formula:

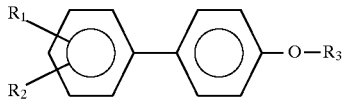

wherein $R_1$ is hydrogen or hydroxyl; $R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

The subsitituted biphenyl polyalkyl ethers of the present invention are useful as fuel additives for the prevention and control of engine deposits.

29 Claims, No Drawings

SUBSTITUTED BIPHENYL ETHERS AND FUEL COMPOSITIONS CONTAINING THE SAME

BACKGROUND OF THE INVENTION

1. Field of the Invention

This invention relates to substituted biphenyl polyalkyl ethers and to fuel compositions containing substituted biphenyl polyalkyl ethers to prevent and control engine deposits.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, polyether amine fuel additives are well known in the art for the prevention and control of engine deposits. These polyether additives have a polyoxyalkylene "backbone", i.e., the polyether portion of the molecule consists of repeating oxyalkylene units. U.S. Pat. No. 4,191,537, issued Mar. 4, 1980 to Lewis et al., for example, disclose a fuel composition comprising a major portion of hydrocarbons boiling in the gasoline range and from 30 to 2,000 ppm of a hydrocarbyl polyoxyalkylene aminocarbamate having a molecular weight from about 600 to 10,000, and at least one basic nitrogen atom. The hydrocarbyl polyoxyalkylene moiety is composed of oxyalkylene units having from 2 to 5 carbon atoms in each oxyalkylene unit. These fuel compositions are taught to maintain the cleanliness of intake systems without contributing to combustion chamber deposits.

Aromatic compounds containing a poly(oxyalkylene) moiety are also known in the art. For example, the above-mentioned U.S. Pat. No. 4,191,537, discloses alkylphenyl poly(oxyalkylene) polymers which are us intermediates in the preparation of alkylphenyl poly(oxyalkylene) aminocarbamates.

Similarly, U.S. Pat. No. 4,881,945, issued Nov. 21, 1989 to Buckley, discloses a fuel composition comprising a hydrocarbon boiling in the gasoline or diesel range and from about 30 to about 5,000 parts per million of a fuel soluble alkylphenyl polyoxyalkylene aminocarbamate having at least one basic nitrogen and an average molecular weight of about 800 to 6,000 and wherein the alkyl group contains at least 40 carbon atoms.

U.S. Pat. No. 5,090,914, issued Feb. 25, 1992 to Reardan et al., disclose poly(oxyalkylene) aromatic compounds having an amino or hydrazinocarbonyl substituent on the aromatic moiety and an ester, amide, carbamate, urea or ether linking group between the aromatic moiety and the poly (oxyalkylene) moiety. These compounds are taught to be useful for modifying macromolecular species such as proteins and enzymes. U.S. Pat. Nos. 5,081,295; 5,103,039; and 5,157,099; all issued to Reardan et al., disclose similar poly(oxyalkylene) aromatic compounds.

U.S. Pat. No. 5,296,003, issued Mar. 22, 1994 to Cherpeck discloses certain hydroxyaromatic ethers having a poly(oxyalkylene) "tail" provide excellent control of engine deposits, especially intake valve deposits, when employed as fuel additives in fuel compositions.

My commonly assigned copending U.S. patent application Ser. No. 08/581,658, filed Dec. 29, 1995, discloses a novel fuel-soluble substituted aromatic polyalkyl ether fuel additive which is useful for the prevention and control of engine deposits, particularly intake valve deposits, when employed as fuel additives in fuel compositions.

It has now been discovered that certain substituted biphenyl polyalkyl ethers are surprisingly useful for reducing engine deposits, especially intake valve deposits, when employed as fuel additives in fuel compositions.

SUMMARY OF THE INVENTION

The present invention provides novel substituted biphenyl polyalkyl ether fuel additives which are useful for the prevention and control of engine deposits, particularly intake valve deposits.

The substituted biphenyl polyalkyl ethers of the present invention have the formula:

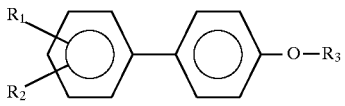

Formula I wherein $R_1$ is hydrogen or hydroxyl; $R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

The present invention further provides a fuel composition comprising a major amount of hydrocarbons boiling in the gasoline or diesel range and an effective deposit-controlling amount of a substituted biphenyl polyalkyl ether of formula I above.

The present invention additionally provides a fuel concentrate comprising an inert stable oleophilic organic solvent boiling in the range of from about 150° F. (65° C.) to about 400° F. (205° C.) and from about 10 to about 70 weight percent of a of substituted biphenyl polyalkyl ethers formula I above.

The present invention also provides a method for reducing engine deposits in an internal combustion engine comprising operating the engine with a fuel composition containing an effective deposit-controlling amount of a substituted biphenyl polyalkyl ethers of formula I above.

Among other factors, the present invention is based on the surprising discovery that certain substituted biphenyl polyalkyl ethers provide excellent control of engine deposits, especially on intake valves, when employed as fuel additives in fuel compositions.

DETAILED DESCRIPTION OF THE INVENTION

The substituted biphenyl polyalkyl ethers of the present invention have the general formula:

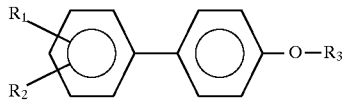

Formula I wherein $R_1$, $R_2$, and $R_3$ are as defined above.

In formula I, $R_1$ is preferably hydrogen.

Preferably, $R_2$ is hydroxyl, amino, or aminomethyl. More preferably, $R_2$ is amino or aminomethyl. Most preferably, $R_2$ is an amino group.

Preferably $R_3$ is a polyalkyl group having an average molecular weight in the range of about 500 to about 5,000, more preferably about 500 to about 3,000, and most preferably about 600 to about 2,000. It is especially preferred that $R_3$ have an average molecular weight of about 700 to about 1,500.

When $R_2$ is an N-alkylamino or N-alkylaminomethyl group, the alkyl group of the N-alkylamino or N-alkylaminomethyl moiety preferably contains 1 to about 4 carbon atoms. More preferably, the alkyl group is methyl or ethyl. For example, particularly preferred groups are N-methylamino, N-ethylamino, N-methylaminomethyl, and N-ethylaminomethyl.

Further, when $R_2$ is an N,N-dialkylamino or N,N-dialkylaminomethyl group, each alkyl group of the N,N-dialkylamino or N,N-dialkylaminomethyl moiety preferably contains 1 to about 4 carbon atoms. More preferably, each alkyl group is either methyl or ethyl. For example, particularly preferred groups are N,N-dimethylamino, N-ethyl-N-methylamino, N,N-diethylamino, N,N-dimethylaminomethyl, N-ethyl-N-methylaminomethyl, and N,N-diethylaminomethyl.

A preferred group of substituted biphenyl polyalkyl ethers for use in this invention are compounds of formula I wherein $R_1$ is hydrogen or hydroxy; $R_2$ is hydroxy, amino, or aminomethyl; and $R_3$ is a polyalkyl group having an average molecular weight of about 500 to about 5,000.

A more preferred group of substituted biphenyl polyalkyl ethers are those of formula I wherein $R_1$ is hydrogen; $R_2$ is amino or aminomethyl; and $R_3$ is a polyalkyl group having an average molecular weight of about 500 to about 3,000.

A particularly preferred group of substituted biphenyl polyalkyl ethers are those of formula I wherein $R_1$ is hydrogen; $R_2$ is amino; and $R_3$ is a polyalkyl group having an average molecular weight of about 600 to about 2,000.

It is especially preferred that the hydroxyl, amino, aminomethyl, N-alkylamino, N-alkylaminomethyl, N,N-dialkylamino, or N,N-dialkylaminomethyl substituent, $R_2$, present in the aromatic moiety of the substituted biphenyl polyalkyl ethers of this invention be situated in a meta or para position relative to the adjoining phenyl substituent. When the aromatic moiety also contains a hydroxyl group as the $R_1$ substituent, it is particularly preferred that this hydroxyl group be in a meta or para position relative to the phenyl substituent and in an ortho position relative to the $R_2$ hydroxyl, amino, aminomethyl, N-alkylamino, N-alkylaminomethyl, N,N-dialkylamino, or N,N-dialkylaminomethyl substituent.

The substituted biphenyl polyalkyl ethers of the present invention will generally have a sufficient molecular weight so as to be non-volatile at normal engine intake valve operating temperatures (about 200° C. to about 250° C.). Typically, the molecular weight of the substituted biphenyl polyalkyl ethers will range from about 600 to about 10,000, preferably from about 1,000 to about 3,000.

Fuel-soluble salts of the substituted biphenyl polyalkyl ethers of the present invention can be readily prepared for those compounds containing an amino, aminomethyl, N-alkylamino, N-alkylaminomethyl, N,N-dialkylamino, or N,N-dialkylaminomethyl group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluene sulfonic acid and methane sulfonic acid.

Fuel-soluble salts of the substituted biphenyl polyalkyl ethers of the present invention can also be readily prepared for those compounds containing a hydroxyl group. Such salts include alkali metal, alkaline earth metal, ammonium, substituted ammonium, and sulfonium salts. Perferred metal salts are the alkaline metal salts, particularly, the sodium and potassium salts, and the substituted ammonium salts, particularly, tetraalkyl-substituted ammonium salts, such as the tetrabutylammonium salts.

Definitions

As used herein, the following terms have the following meanings unless expressly stated to the contrary.

The term "amino" refers to the group: —$NH_2$.

The term "aminomethyl" refers to the group: —$CH_2NH_2$.

The term "cyano" refers to the group: —CN.

The term "nitro" refers to the group: —$NO_2$.

The term "N-alkylamino" refers to the group: —$NHR_a$ wherein $R_a$ is an alkyl group.

The term "N,N-dialkylamino" refers to the group: —$NR_bR_c$ wherein $R_b$ and $R_c$ are alkyl groups.

The term "N-alkylaminomethyl" refers to the group: —$CH_2NHR_d$ wherein $R_d$ is an alkyl group. The term "N,N-dialkylaminomethyl" refers to the group: —$CH_2NR_eR_f$ wherein $R_e$ and $R_f$ are alkyl groups.

The term "alkyl" refers to both straight- and branched-chain alkyl groups.

The term "lower alkyl" refers to alkyl groups having 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "polyalkyl" refers to an alkyl group which is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The term "lower alkoxy" refers to the group —$OR_g$ wherein $R_g$ is lower alkyl. Typical lower alkoxy groups include methoxy, ethoxy, and the like.

The term "fuel" or "hydrocarbon fuel" refers to normally liquid hydrocarbons having boiling points in the range of gasoline and diesel fuels.

General Synthetic Procedures

The substituted biphenyl polyalkyl ethers of this invention can be prepared by the following general methods and procedures. Those skilled in the art will recognize that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but one skilled in the art will be able to determine such conditions by routine optimization procedures.

Moreover, those skilled in the art will recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, *Protective Groups in Organic Synthesis*, Second Edition, Wiley, New York, 1991, and references cited therein.

In the present synthetic procedures, a hydroxyl group will preferably be protected, when necessary, as the benzyl or tert-butyldimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the substituted biphenyl polyalkyl ethers of this invention having an amino group on the aromatic moiety will generally be prepared from the corresponding nitro derivative. Accordingly, in many of the following procedures, a nitro group will serve as a protecting group for the amino moiety. Moreover, the compounds of this invention having a —$CH_2NH_2$ group on the aromatic moiety will generally be prepared from the corresponding cyano derivative, —CN. Thus, in many of the following procedures, a cyano group will serve as a protecting group for the —$CH_2NH_2$ moiety.

The substituted biphenyl polyalkyl ethers of the present invention may be prepared from a biphenyl compound having the formula:

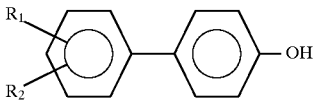

Formula II wherein $R_1$ and $R_2$ are as defined above. $R_2$ may also be hydrogen in the starting material of formula II.

The aromatic compounds of formula II are either known compounds or can be prepared from known compounds by conventional procedures. Aromatic compounds suitable for use as starting materials in this invention include, for example, 4-hydroxy4'-nitrobiphenyl (available from Frinton Labs), and 4,4'-biphenol and 4-hydroxybiphenyl (both available from Aldrich Chemical Company).

In a preferred method of synthesizing the substituted biphenyl polyalkyl ethers of the present invention, an aromatic compound of formula II is deprotonated with a suitable base to provide a metal salt having the formula:

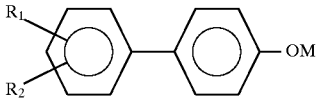

Formula III wherein $R_1$ and $R_2$ are as defined above; and M is a metal cation, such as lithium, sodium, or potassium.

Generally, this deprotonation reaction will be effected by contacting II with a base, such as potassium hydroxide, and the like, in a solvent, such as ethanol, at a temperature in the range from about −10° C. to about 50° C. for about 5 minutes to about 3 hours. Alternatively, the metal salt may also be prepared by the hydrolysis of an ester of the substituted hydroxybiphenyl. For example, the hydrolysis of a benzoate ester of a hydroxybiphenyl is described in EP 231,770.

Metal salt III is reacted with a polyalkyl derivative having the formula:

$R_3$—W Formula IV wherein $R_3$ is as defined above and W is a suitable leaving group, such as a sulfonate or a halide, to provide a substituted biphenyl polyalkyl ether of the formula:

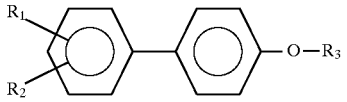

wherein $R_1$, $R_2$, and $R_3$ are as defined above.

Generally, this reaction will be conducted by contacting IV with about 0.8 to about 5 molar equivalents of III in an inert solvent, such as toluene, tetrahydrofuran, dimethylformamide, and the like, under substantially anhydrous conditions at a temperature in the range of about 25° C. to about 150° C. for 1 to about 100 hours.

The polyalkyl derivative IV may be derived from a polyalkyl alcohol having the formula:

$R_3$—OH Formula V

The polyalkyl alcohols of formula V may also be prepared by conventional procedures known in the art. Such procedures are taught, for example, in U.S. Pat. Nos. 5,055,607 to Buckley and 4,859,210 to Franz et al., the disclosures of which are incorporated herein by reference.

In general, the polyalkyl substituent on the polyalkyl alcohols of Formula V and the resulting polyalkyl aromatic esters of the present invention will have an average molecular weight in the range of about 450 to about 5,000, preferably about 500 to about 5,000, more preferably about 500 to 3,000, and most preferably about 600 to about 2,000.

The polyalkyl substituent on the polyalkyl alcohols employed in the invention may be generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl alcohols are polyisobutenes which comprise at least about 20% of the more reactive methylvinylidene isomer, preferably at least about 50% and more preferably at least about 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Such polyisobutenes, known as "reactive" polyisobutenes, yield high molecular weight alcohols in which the hydroxyl group is at or near the end of the hydrocarbon chain.

Examples of suitable polyisobutenes having a high alkylvinylidene content include Ultravis 30, a polyisobutene having a molecular weight of about 1,300 and a methylvinylidene content of about 74%, and Ultravis 10, a polyisobutene having a molecular weight of about 950 and a methylvinylidene content of about 76%, both available from British Petroleum.

The polyalkyl alcohols may be prepared from the corresponding olefins by conventional procedures. Such procedures include hydration of the double bond to give an alcohol. Suitable procedures for preparing such long-chain alcohols are described in I. T. Harrison and S. Harrison, *Compendium of Organic Synthetic Methods*, Wiley-Interscience, New York (1971), pp. 119–122, as well as in U.S. Pat. Nos. 5,055,607 and 4,859,210.

The hydroxyl group of the polyalkyl moiety of formula V may be converted into a suitable leaving group by contacting formula V with a sulfonyl chloride to form a sulfonate ester, such as a methanesulfonate (mesylate) or a toluenesulfonate (tosylate). Typically, this reaction is conducted in the presence of a suitable amine, such as triethylamine or pyridine, in an invert solvent, such as dichloromethane, at a temperature in the range of about −10° C. to about 30° C. Alternatively, the hydroxyl group of the polyalkyl moiety of formula V can be exchanged for a halide, such as chloride or bromide, by contacting formula V with a halogenating agent, such as thionyl chloride, oxalyl chloride, or phosphorus tribromide. Other suitable methods for preparing sulfonates and halides from alcohols, and appropriate reaction conditions for such reactions, can be found for example, in I. T. Harrison and S. Harrison, *Compendium of Organic Synthetic Methods*, Vol. 1, pp. 331–337, Wiley-Interscience, New York (1971) and references cited therein.

Generally, this reaction is conducted in an invert solvent, such as toluene, dichloromethane, diethyl ether, and the like, at a temperature in the range of about 25° C. to about 150° C., and is generally complete in about 0.5 to about 48 hours. When an acyl halide is employed as the acylating agent, this reaction is preferably conducted in the presence of a sufficient amount of an amine capable of neutralizing the acid generated during the reaction, such as triethylamine, di(isopropyl)ethylamine, pyridine, or 4-dimethylaminopyridine.

Additional methods for preparing esters from alcohols, and suitable reaction conditions for such reactions, can be found, for example, in I. T. Harrison and S. Harrison, *Compendium of Organic Synthetic Methods*, Vol.1, pp. 273–276 and 280–283, Wiley-Interscience, New York (1971) and references cited therein.

When the substituted biphenyl alcohol of formula II contains a hydroxyl group, for example, when one of $R_1$ or $R_2$ is hydroxyl, protection of the aromatic hydroxyl groups may be accomplished using well-known procedures. The choice of a suitable protecting group for a particular hydroxy substituted biphenyl alcohol will be apparent to those skilled in the art. Various protecting groups, and their introduction and removal, are described, for example, in T. W. Greene and P. G. M. Wuts, *Protective Groups in Organic Synthesis*, Second Edition, Wiley, New York, 1991, and references cited therein.

Deprotection of the substituted biphenyl hydroxyl group (s) can also be accomplished using conventional procedures. Appropriate conditions for this deprotection step will depend upon the protecting group(s) utilized in the synthesis and will be readily apparent to those skilled in the art. For example, benzyl protecting groups may be removed by hydrogenolysis under 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from 0° C. to about 40° C. for 1 to about 24 hours.

When synthesizing the substituted biphenyl polyalkyl ethers of formula I having an amino or aminomethyl group on the aromatic moiety (i.e., where $R_2$ is an amino or aminomethyl group), it is generally desirable to first prepare the corresponding nitro or cyano compound (i.e., where $R_2$ is a nitro or cyano group) using the above-described synthetic procedures, and then to reduce the nitro or cyano group to an amino or aminomethyl group, respectively, using conventional procedures. Aromatic nitro or cyano groups may be reduced to amino or aminomethyl groups, respectively, using a number of procedures that are well known in the art. See, or example, the article entitled, "*Amination by Reduction*" in Kirk-Othmer "*Encyclopedia of Chemical Technology*", second Edition, Vol. 2, pp 76–99. Generally, such reductions can be carried out with, for example, hydrogen, carbon monoxide, or hydrazine, (or mixtures of the same) in the presence of metallic catalysts such as palladium, platinum, and its oxides, nickel, copper chromite, etc. Co-catalysts such as alkali or alkaline earth metal hydroxides or amines (including amino phenols) can be used in these catalyzed reductions.

Reductions can also be accomplished through the use of reducing metals in the presence of acids, such as hydrochloric acid. Typical reducing metals are zinc, iron, and tin; salts of these metals can also be used.

Typically, the amino or aminomethyl substituted biphenyl polyalkyl ethers of the present invention are obtained by reduction of the corresponding nitro or cyano compound with hydrogen in the presence of a metallic catalyst such as palladium. This reduction is generally carried out at temperatures of about 20° C. to about 100° C., preferably, about 20° C. to about 40° C., and hydrogen pressures of about atmospheric to about 200 psig, typically, about 20 to about 80 psig. The reaction time for reduction usually varies between about 5 minutes to about 24 hours. Substantially, inert liquid diluents and solvents, such as ethanol, cyclohexane, ethyl acetate, toluene, etc, can be used to facilitate the reaction. The substituted biphenyl polyalkyl ethers of the present invention can then be obtained by well-known techniques.

Fuel Compositions

The substituted biphenyl polyalkyl ethers of the present invention are useful as additives in hydrocarbon fuels to prevent and control engine deposits, particularly intake valve deposits. Typically, the desired deposit control is achieved by operating an internal combustion engine with a fuel composition containing a substituted biphenyl polyalkyl ether of the present invention. The proper concentration of additive necessary to achieve the desired level of deposit control varies depending upon the type of fuel employed, the type of engine, and the presence of other fuel additives.

In general, the concentration of the substituted biphenyl polyalkyl ethers of this invention in hydrocarbon fuel will range from about 50 to about 2,500 parts per million (ppm) by weight, preferably from about 75 to about 1,000 ppm. When other deposit control additives are present, a lesser amount of the present additive may be used.

The substituted biphenyl polyalkyl ethers of the present invention may also be formulated as a concentrate using an inert stable oleophilic (i.e., dissolves in gasoline) organic solvent boiling in the range of about 150° F. to about 400° F. (about 65° C. to about 205° C.). Preferably, an aliphatic or an aromatic hydrocarbon solvent is used, such as benzene, toluene, xylene, or higher-boiling aromatics or aromatic thinners. Aliphatic alcohols containing about 3 to about 8 carbon atoms, such as isopropanol, isobutylcarbinol, n-butanol, and the like, in combination with hydrocarbon solvents are also suitable for use with the present additives. In the concentrate, the amount of the additive will generally range from about 10 to about 70 weight percent, preferably about 10 to about 50 weight percent, more preferably from about 20 to about 40 weight percent.

In gasoline fuels, other fuel additives may be employed with the additives of the present invention, including, for example, oxygenates, such as t-butyl methyl ether, anti-knock agents, such as methylcyclopentadienyl manganese tricarbonyl, and other dispersants/detergents, such as hydrocarbyl amines, hydrocarbyl polyalkyl amines, or succinimides. Additionally, antioxidants, metal deactivators, and demulsifiers may be present.

In diesel fuels, other well-known additives can be employed, such as pour point depressants, flow improvers, cetane improvers, and the like.

A fuel-soluble, nonvolatile carrier fluid or oil may also be used with the substituted biphenyl polyalkyl ethers of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Patent Application Nos. 356,726 and 382,159, published Mar. 7, 1990 and Aug. 16, 1990, respectively.

These carrier fluids are believed to act as a carrier for the fuel additives of the present invention and to assist in removing and retarding deposits. The carrier fluid may also exhibit synergistic deposit control properties when used in combination with a substituted biphenyl polyalkyl ethers of this invention.

The carrier fluids are typically employed in amounts ranging from about 100 to about 5,000 ppm by weight of the hydrocarbon fuel, preferably from about 400 to about 3,000 ppm by weight of the fuel. Preferably, the ratio of carrier fluid to deposit control additive will range from about 0.5:1 to about 10:1, more preferably from 1:1 to about 4:1, most preferably about 2:1.

When employed in a fuel concentrate, carrier fluids will generally be present in amounts ranging from about 20 to about 60 weight percent, preferably from about 30 to about 50 weight percent.

EXAMPLES

The following examples are presented to illustrate specific embodiments of the present invention and synthetic preparations thereof; and therefore these examples should not be interpreted as limitations upon the scope of this invention.

Example 1

Preparation of

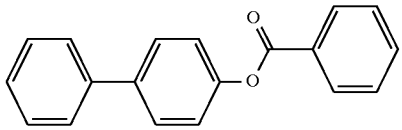

To a flask equipped with a magnetic stirrer, thermometer, septum and nitrogen inlet was added 4-hydroxybiphenyl (30.0 grams), triethylamine (31.8 mL) and anhydrous tetrahydrofuran (300 mL). Benzoyl chloride (22.5 mL) was added via syringe and the resulting mixture was stirred at room temperature for 4 hours. The reaction was filtered and the solvent removed in vacuo. The resulting solid was washed with water followed by hot methanol. The solid was then recrystallized from n-butanol to yield 40.7 grams of the desired product as a white solid.

Example 2

Preparation of

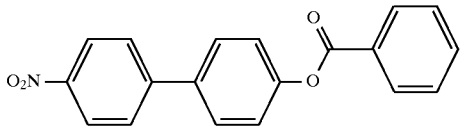

To a flask equipped with a magnetic stirrer, thermometer, addition funnel and nitrogen inlet was added 20.0 grams of the product from Example 1 and glacial acetic acid (160 mL). The reaction was heated to 85° C. and fuming nitric acid (48 mL) was added at a rate to maintain the temperature between 85°–90° C. The reaction mixture was stirred an additional 30 minutes at 85° C. and then filtered while hot. The resulting solid was washed with water followed by methanol. The solid was then recrystallized from acetic acid to yield 8.5 grams of the desired product as a light yellow solid.

Example 3

Preparation of

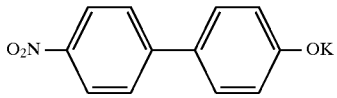

To a flask equipped with a magnetic stirrer, reflux condenser, addition funnel and nitrogen inlet was added 8.5 grams of the product from Example 2 and ethanol (50 mL). The reaction was heated to reflux and potassium hydroxide (5.1 grams dissolved in 17.1 mL of water) was added dropwise. The reaction was refluxed for an additional 30 minutes and then cooled to room temperature. The resulting solid was filtered and washed three times with tetrahydrofuran to yield the desired product as a purple solid.

Example 4

Preparation of

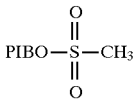

Polyisobutanol (50.0 grams, molecular weight average 984, prepared via hydroformylation of Amoco H-100 polyisobutene), triethylamine (7.7 mL), and anhydrous dichloromethane (500 mL) were combined. The solution was cooled to 0° C. and methanesulfonyl chloride (4.1 mL) was added dropwise. The reaction was stirred at room temperature under nitrogen for 16 hours. The solution was diluted with dichloromethane (1000 mL) and was washed twice with saturated aqueous sodium bicarbonate solution and once with brine. The organic layer was dried over anhydrous sodium sulfate, filtered and the solvents removed in vacuo to yield 59.0 grams as a yellow oil.

Example 5

Preparation of

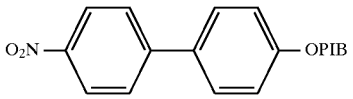

The product from Example 3 (3.0 grams) and the product from Example 4 (14.0 grams) were combined with anhydrous toluene (100 mL), dimethylformamide (25 mL) and Adogen 464 ( ) 15 grams). The reaction was refluxed for sixteen hours, cooled to room temperature and diluted with diethyl ether (1000 mL). The diethyl ether solution was washed twice with water and once with brine. The organic layer was dried over anhydrous magnesium sulfate, filtered and the solvents removed in vacuo to yield 11.9 grams as a yellow oil. The oil was chromatographed on silica gel eluting with hexane/ethyl acetate (90:10) to afford 7.6 grams of the desired product as a yellow oil.

Example 6

Preparation of

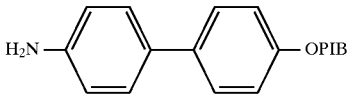

A solution of 7.6 grams of the product from Example 5 in 100 mL of ethyl acetate containing 0.5 grams of 10% palladium on charcoal was hydrogenolyzed at 35–40 psi for 16 hours on a Parr low-pressure hydrogenator. Catalyst filtration and removal of the solvent in vacuo yield 6.9 grams of the desired product as a yellow oil.

$^1$H NMR ($CDCl_3$) d 7.45 (AB quartet, 2H), 7.35 (AB quartet, 2H), 6.9 (AB quartet, 2H), 6.75 (AB quartet, 2H), 4.0 (t, 2H), 3.7 (bs, 2H), 0.7–1.6 (m, 137H).

Example 7

Single-Cylinder Engine Test

The data in Table I illustrates the significant reduction in intake valve deposits provided by the substituted biphenyl polyalkyl ethers of the present invention (Example 6) compared to the base fuel.

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the value at the end of the run. The differences between the two weights is the weight of the deposit. A lesser amount of deposit indicates a superior additive. The operating conditions of the test were as follows: water jacket temperature 200° F.; vacuum of 12 in Hg, air-fuel ratio of 12, ignition spark timing of 400 BTC; engine speed is 1800 rpm; the crankcase oil is a commercial 30 W oil.

The amount of carbonaceous deposit in milligrams on the intake valves is reported for each of the test compounds in Table I.

TABLE I

| | Intake Valve Deposit Weight (in milligrams) | | |
|---|---|---|---|
| Sample[1] | Run 1 | Run 2 | Average |
| Base Fuel | 328.0 | 319.5 | 323.8 |
| Example 6 | 25.7 | 60.2 | 43.0 |

[1]At 125 parts per million actives (ppma).

The base fuel employed in the above single-cylinder engine tests was a regular octane unleaded gasoline containing no fuel detergent. The test compounds were admixed with the base fuel to give the concentrations indicated in the tables.

The data in Table I illustrates the significant reduction in intake valve deposits provided by the substituted biphenyl polyalkyl ethers of the present invention (Example 6) compared to the base fuel.

What is claimed is:

1. A compound of the formula:

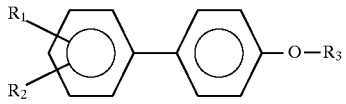

wherein:

$R_1$ is hydrogen or hydroxyl;

$R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

2. The compound according to claim 1, wherein $R_1$ is hydrogen and $R_2$ is amino or aminomethyl.

3. The compound according to claim 2, wherein $R_2$ is amino.

4. The compound according to claim 1, wherein $R_3$ is a polyalkyl group having an average molecular weight in the range of about 500 to about 5,000.

5. The compound according to claim 4, wherein $R_3$ has an average molecular weight in the range of about 500 to about 3,000.

6. The compound according to claim 5, wherein $R_3$ has an average molecular weight in the range of about 600 to about 2,000.

7. The compound according to claim 6, wherein $R_3$ is a polyalkyl group derived from polypropylene, polybutene, or polyalphaolefin oligomers of 1-octene or 1-decene.

8. The compound according to claim 7, wherein $R_3$ is derived from polyisobutene.

9. The compound according to claim 8, wherein the polyisobutene contains at least about 20% of a methylvinylidiene isomer.

10. A fuel composition comprising a major amount of hydrocarbons boiling in the gasoline or diesel range and an effective deposit-controlling amount of a compound of the formula:

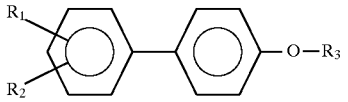

wherein:

$R_1$ is hydrogen or hydroxyl;

$R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 4 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

11. The fuel composition according to claim 10, wherein $R_1$ is hydrogen and $R_2$ is amino or aminomethyl.

12. The fuel composition according to claim 11, wherein $R_2$ is amino.

13. The fuel composition according to claim 10, wherein $R_3$ is a polyalkyl group having an average molecular weight in the range of about 500 to about 5,000.

14. The fuel composition according to claim 13, wherein $R_3$ has an average molecular weight in the range of about 500 to about 3,000.

15. The fuel composition according to claim 14, wherein $R_3$ has an average molecular weight in the range of about 600 to about 2,000.

16. The fuel composition according to claim 15, wherein $R_3$ is a polyalkyl group derived from propylene, polybutene, or polyalphaolefin oligomers of 1-octene or 1-decene.

17. The fuel composition according to claim 16, wherein $R_3$ is derived from polyisobutene.

18. The fuel composition according to claim 17, wherein the polyisobutene contains at least 20% of a methylvinylidene isomer.

19. A method for reducing engine deposits in an internal combustion engine comprising operating an internal combustion engine with the fuel composition of claim 10.

20. A fuel concentrate comprising an inert stable oleophilic organic solvent boiling in the range of from about 150° F. to about 400° F. and from about 10 to about 70 weight percent of a compound of the formula:

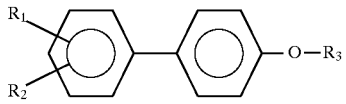

wherein:

$R_1$ is hydrogen or hydroxyl;

$R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

21. The fuel concentrate according to claim 20, wherein $R_1$ is hydrogen and $R_2$ is amino or aminomethyl.

22. The fuel concentrate according to claim 21, wherein $R_2$ is amino.

23. The fuel concentrate according to claim 20, wherein $R_3$ has an average molecular weight in the range of about 500 to about 5,000.

24. The fuel composition according to claim 23, wherein $R_3$ has an average molecular weight in the range of about 500 to about 3,000.

25. The fuel concentrate according to claim 24, wherein $R_3$ has an average molecular weight in the range of about 600 to about 2,000.

26. The fuel concentrate according to claim 25, wherein $R_3$ is a polyalkyl group derived from polypropylene, polybutene, or polyalphaolefin oligomers of 1-octene or 1-decene.

27. The fuel concentrate according to claim 26, wherein $R_3$ is derived from polyisobutene.

28. The fuel concentrate according to claim 27, wherein the polyisobutene contains at least about 20% of a methylvinylidiene isomer.

29. The fuel concentrate according to claim 20, wherein the fuel concentrate further contains from about 20 to about 60 weight percent of a fuel-soluble, nonvolatile carrier fluid.

* * * * *